United States Patent [19]

Gomes

[11] Patent Number: 4,926,717

[45] Date of Patent: May 22, 1990

[54] BOTTLE UNCAPPING AND RECAPPING MACHINE

[75] Inventor: Francis Gomes, Jersey City, N.J.

[73] Assignee: Manostat Corporation, New York, N.Y.

[21] Appl. No.: 403,088

[22] Filed: Sep. 5, 1989

[51] Int. Cl.[5] ..... B67B 7/18

[52] U.S. Cl. ..... 81/3.2; 81/3.42

[58] Field of Search ..... 81/3.2, 3.33, 3.4, 3.42; 53/381 A, 381 R

[56] References Cited

U.S. PATENT DOCUMENTS

| | | | |
|---|---|---|---|
| 4,718,312 | 1/1988 | Jones | 81/3.2 |
| 4,762,029 | 8/1988 | Chen | 81/3.2 |
| 4,833,948 | 5/1989 | Jones | 81/3.2 |

*Primary Examiner*—Roscoe V. Parker

*Attorney, Agent, or Firm*—Abelman, Frayne, Rezac & Schwab

[57] ABSTRACT

A machine for removing and subsequently reapplying bottle caps to bottles having a threaded neck is actuated by the presentation of a bottle neck to a rotatable chuck to either apply or remove a bottle cap.

8 Claims, 3 Drawing Sheets

FIG. 1
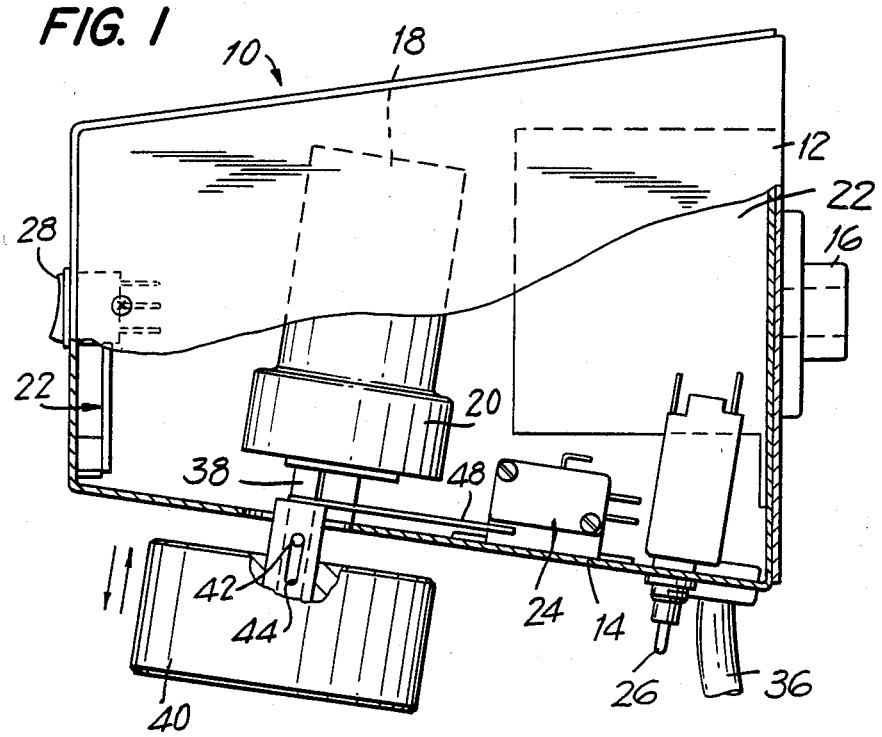
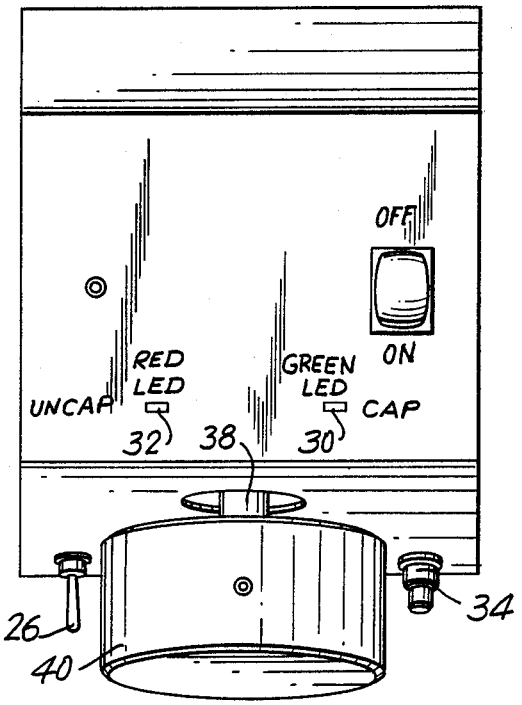
FIG. 2

FIG. 4
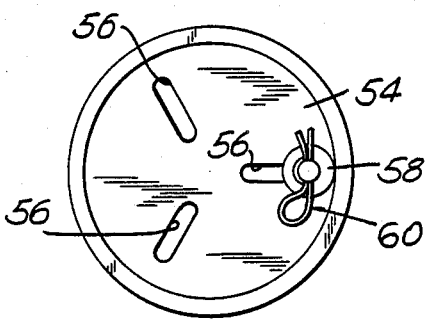
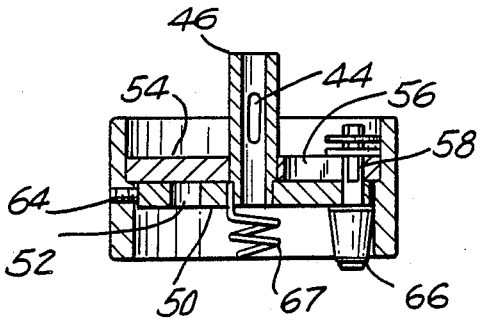
FIG. 3
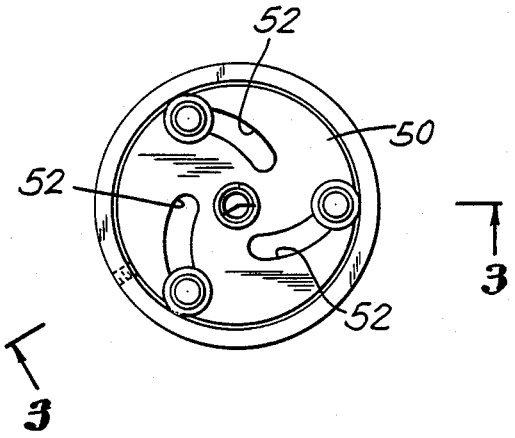
FIG. 5

BOTTLE UNCAPPING AND RECAPPING MACHINE

FIELD OF THE INVENTION

This invention relates to a machine for use in the removal of a screw threaded cap from the neck of a bottle in order to permit filling of the bottle or removal of the contents thereof, and which is then operative to reapply the cap onto the neck of the bottle in an automatic manner requiring no manipulation of controls of the machine.

This machine can also operate in a specific direction, either for tighter caps placed on top of bottles, or counter clockwise rotation to remove caps.

The term bottle is used in the specification to include glass bottles and those formed from plastics or other materials, and also to include jars or containers of any form to which a threaded cap has been applied.

BACKGROUND OF THE INVENTION

Considerable attention in industry has been given to the automatic capping of filled bottles, and, such an operation is to be considered as being notorious in the art.

Further, machines for capping bottles and uncapping them are known, for example, from U.S. Pat. No. 4,178,732, Pfleger, issued Dec. 18, 1979, and U.S. Pat. No. 4,762,029, Chen, issued Aug. 9, 1988. However, in these patents manual intervention on the part of the operator is required in order to cause the machine to operate in a specific direction, either for uncapping a bottle, or, recapping a bottle. Further, the structures disclosed in these patents are not readily adapted to the quick removal of a bottle cap of a single bottle by a laboratory worker who is holding the bottle in one of the workers hands, and then, the reapplication of the bottle caP to the bottle in an entirely automatic manner requiring no manipulation of controls of the device by the worker, subsequent to the worker having performed some operation on the interior of the bottle.

SUMMARY OF THE INVENTION

According to the present invention, an entirely automatic machine is provided for removing a bottle cap from a bottle while the bottle is held in a worker's hand, the bottle cap then being retained in the machine while the laboratory worker performs an operation on the bottle interior, such as the addition of removal of substances to or from the bottle interior. Then, the machine of the present invention automatically becomes operative to reapply the bottle cap to the bottle while still held in the worker's hand, merely by presenting the threaded neck of the bottle to the bottle cap. Thus, the entire uncapping and capping operation can be performed while the bottle is held in one hand of the laboratory worker the other hand of the laboratory worker at all times being free to perform other tasks not related to the bottle uncapping and capping operations.

The machine of the present invention includes a base member which houses a drive motor, and which also houses the controls for that motor.

The drive motor is a reversible motor, and is employed to rotate a chucking device of the machine. The chucking device is exposed externally of the machine base, and is displacable along its longitudinal axis of rotation by a predetermined amount, and into engagement with micro switches controlling energization of the motor, and, signal the controller to control direction of rotation of the motor.

Thus, in use of the machine, the laboratory worker is merely required to pick up a bottle using one hand, and to insert the cap of the bottle into frictional engagement with the interior of the chuck. This movement by the laboratory worker will cause axial movement of the chuck, which in turn automatically will energize the motor.

Once the bottle cap has been removed from the bottle and the bottle neck removed from the chuck, the chuck then drops by gravity to disengage the motor, and also, one of the micro switch signals to set the electronic controller which reverses the direction of rotation of the motor from the direction of rotation of previous usage. On the next axial movement of the chuck, that is when the neck of the bottle is reinserted into the chuck, the machine will recap the bottle.

On recapping of a bottle, there is a danger that the laboratory worker will continue to hold the bottle with the chuck forced upwardly and in a direction to maintain the motor energized. To prevent over torquing of the bottle cap, the electrical control circuit of the motor includes a current sensitive device which will disable the motor when a predetermined electrical current is exceeded. Additionally, the motor control circuit preferably includes a time delay switch, which will disable the motor in the event that slippage occurs between the bottle cap and the interior of the chuck. Conveniently, these controls operate under the control of a solid state circuitry to energize light emitting diodes indicative of the operating conditions of the machine.

By use of the machine, in one quick movement the cap of a bottle is removed from the bottle while the bottle is held in one of the laboratory worker's hands, the machine is disabled immediately the bottle is withdrawn from the machine, and then, in one quick movement the cap is reapplied to the bottle at the time the neck of the bottle is presented to the cap held captive in the machine. In this manner, only one of the laboratory workers' hands is required to perform the capping and uncapping operations, without the requirement to release the bottle in order to operate directional switches controlling the machine.

DESCRIPTION OF THE DRAWINGS

A preferred embodiment of the present invention will now be described with reference to the accompanying drawings in which:

FIG. 1 is a side view of the device, partially in cross-section;

FIG. 2 is a front view of the device;

FIG. 3 is a cross-section through a chucking device employed in the construction of FIGS. 1 and 2;

FIG. 4 is a fragmentary plan view of FIG. 3;

FIG. 5 is an underside plan view of FIG. 3; and,

DESCRIPTION OF THE PREFERRED EMBODIMENT

Figure 6:
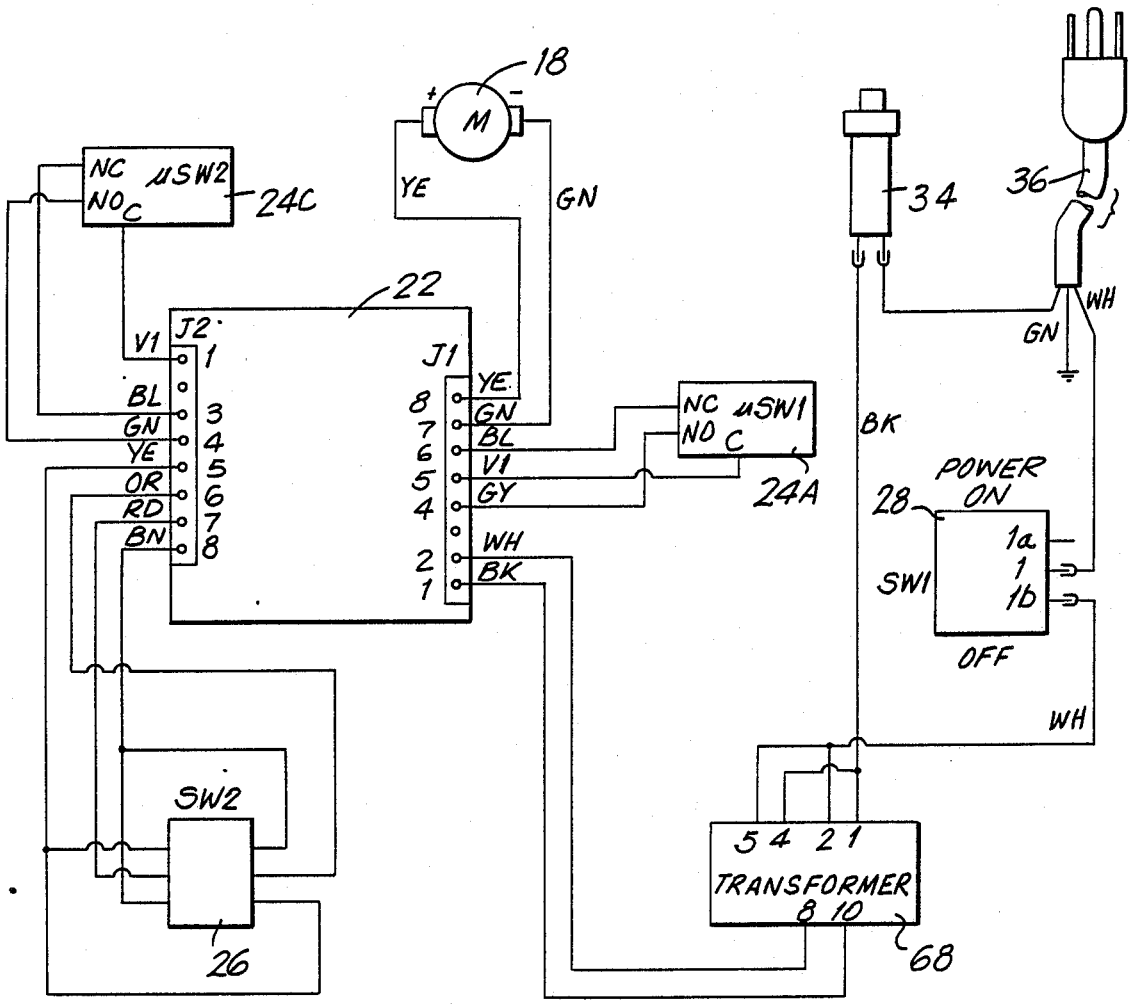
FIG. 6 is a circuit diagram illustrating the electrical circuits of the device.

Referring now to FIG. 1, the device includes a housing, indicated generally at 10, and, which is comprised of two sheet metal housing portions 12 and 14, which are connected one to the other in a manner immobilizing them against relative movement with respect to each other, the housing 10 having rigidly connected thereto a boss 16, by means of which the device can be supported from a workbench or a stand (not shown) the intention being the device be provided with a sturdy and non-tipping support of any known type.

Contained within the housing 10 is an electrical motor 18 having a reduction gear 20, of any conventional type as is well known in the art. The motor 18 is a reversible motor, again as well known in the art, the device including a PC board 22 located within the housing. Also contained within the housing are the necessary switches 24, 26, 28 by means of which the mode of operation of the device is selectable on the initiation of use of the device, the operation of the device then continuing on a pre-set cycle for all subsequent operations of the device.

The switches include a pair of micro switches 24, which, as will be explained later, are employed for energizing the motor, and, for successively signaling the controller to set direction of operation of the motor. A switch 26 is provided, in order to initially set the mode of operation of the device between a first condition in which the device is set for uncapping a bottle and then recapping it, a second condition in which the device is set for tightening caps placed on top of bottles only, and, a third condition in which the device is set for uncapping only.

Conveniently, light emitting diodes 30 and 31 are viewable from the front of the device to indicate in which mode of operation the device has been set. The remaining switch 28 is merely an On-Off switch which can be used in the event that use of the device is to be discontinued overnight, or, the device is to be left unattended for a considerable period of time. Conveniently, a circuit breaker 34 also is provided to protect against misuse or electrical breakdown of the device, the device being provided with an electrical supply cord 36, by means of which the device can be connected to a convenient electrical outlet.

Having initially set the device by switching on the main On-Off switch 28, and the setting of the mode of operation of the device by operation of the directional switch 26, which is a toggle switch, the device operates automatically in all respects under the control of the electronic board 22.

Connected to an output shaft 38 of the reduction gear 20, and slidable axially with respect thereto is a chuck 40. The chuck 40 is fixed on the output shaft 38 for rotation in unison therewith by means of a pin 42 extending transversely of the shaft 38, and which extends into an elongate slot 44 in a drive collar 46 of the chuck. The collar 46 is thus moveable axially of the output shaft 38 between two positions as determined by the axial length of the slot 44. Extending over the collar 46 is a feeler 48, which is connected to the body of the micro switch 24, and, is operative to actuate the micro switch 24 upon movement of the collar 46 in a direction upwardly on the output shaft 38.

Thus, on each upward movement of the collar 46, the micro switch 24 is operated, to establish the power supply to the drive motor 18. Thus, in the event that the device has been set to the uncap-cap mode, a first movement of the collar 46 upwardly on the output shaft 38 will cause the output shaft 38 to rotate in a counter clockwise direction. When the collar 46 has returned to its initial downwardly extended position, micro switch 24B signals the electronic controller to set the next motor direction. A subsequent upward movement of the collar 46 will energize the motor 18 in a direction to produce clockwise rotation of the output shaft 38. A subsequent operation (first going up and then down) of the collar 46 will cause the device to revert to counter clockwise rotation of the output shaft 38.

Referring now to FIGS. 3, 4, and 5, the collar 46 is fast with a circular base plate 50 having three arcuate camming slots 52 extending therethrough, the respective slots 52 converging towards the axis of the base plate 50.

Positioned over the base plate 50 is an adjustable plate 56 which is rotatably mounted on the collar 46 for angular adjustment relative thereto. The adjustable plate 54 has three radially extending slots 56, as shown in FIG. 4, in each of which a post 58 is secured, conveniently by means of a cotter pin 60. The respective post 58 extend parallel to the axis of the collar 44, and, extend through a respective pair of slots 52 and 56, the posts having flats in engagement with the walls of the radial slots 56 operative to prevent rotation of the posts about their respective longitudinal axis. Connected to the adjustment plate 54 at the outer periphery thereof is an adjusting ring 62, the adjusting ring having a grub screw 64, by means of which the angular relation between the base plate 50 and the adjusting plate 54 can be adjusted and then fixed in the adjusted position.

On release of the grub screw 64, the adjusting ring, and with it the adjustment plate 54 can be rotated relative to the base plate 50. So doing will cause the pins 58 to cammed by the arcuate slots 52, thus moving the pins 58 either radially inwardly along the slots 56, or radially outwardly thereof, in order to accommodate bottle caps of different diameters, such as ½ inch, ¾ inch, 1 inch etc. Subsequent to adjustment of the radial position of the posts 58, the grub screw 64 is tightened down to set the chuck in a position to receive and clamp onto a bottle cap of the particular selected size.

Secured on the posts 58 against rotation relative to those posts are buffers 66 molded from an elastomeric material, the respective buffers diverging upwardly towards the base plate 50.

By this arrangement of the chuck construction, the chuck at all times remains dynamically balanced, and substantially free of vibration when rotated.

A removable ejection spring 67, can be added when using the machine for uncapping only. At the uncapping mode the machine uncap the capped bottle and the ejection spring ejects the cap from the chuck.

If now a laboratory technician presents a capped bottle to the interior of the chuck 40, then, the cap of the bottle will pass upwardly between the buffers 66 and will be pressed into frictional engagement therewith. Continued upward movement of the capped bottle will cause the collar 46 to ride upwardly on the output shaft 38, and, in so doing, will cause activation of the drive motor in a direction to unscrew the bottle cap from the neck of the bottle. As the chuck has only limited upward movement, as determined by the extent of the axial slot 44, continued upward movement of the capped bottle by the operator will press the bottle cap into increased frictional engagement with the buffers 66, which will more firmly grip the bottle cap, the bottle cap at that time becoming wedged into the chuck 40 and held by the buffers 66 against axial movement.

Rotation of the output shaft 38 and the chuck will continue, until such time as the cap is removed from the threaded neck of the bottle, and the bottle neck removed from the chuck. At this time, the operator can withdraw the bottle to perform what operations are necessary on the contents thereof. Immediately upon removal of the neck of the bottle from the chuck interior, the chuck drops downwardly by the forces of gravity with the bottle cap held captive therein, this movement of the chuck discontinuing operation of the electric motor by the actuation of the micro switch 24 to its open condition, while at the same time the micro switch signals the electronic to set the electric motor 18 in reverse for the next operator.

To recap the bottle, it is merely necessary for the operator to present the threaded neck of the bottle to the bottle cap held captive in the chuck and to move the bottle upwardly, in order to cause upward movement of the chuck and activation of the electric motor to thread the bottle cap onto the threaded neck of the bottle and firmly seat it on the threaded neck of the bottle by an extent determined by the torque available at the output shaft 38.

The operator is thus provided with a highly convenient "zip off" removal of the bottle cap using but a single hand of the operator to hold the bottle, and then, is provided with a highly convenient "zip on" rethreading of the bottle cap onto the bottle while the bottle is still held in the hand of the operator, there being no requirement to set direction switches or power On and Off switches by use of the operators other hand.

Referring now to FIG. 6 of the drawings, the electrical circuit of the device is illustrated in diagrammatic form.

Power from the electrical supply cord 36 is supplied to a transformer 68 under the control of the power On/Off switch 28. The circuit breaker 34 is included in the electrical supply circuit to protect the transformer against electrical overload.

The motor 18 is connected to the PC board 22, to which respective sections of the micro switch 24 are connected, these sections comprising power on, power off contacts 24A for controlling the energisation of the motor 18, and switch 24B which triggers the electronic controller when the chuck is released to reverse the direction of rotation of the motor 18 for the next operation. Toggle switch 26 is to select the mode of operations. Preferably, the PC board also includes circuitry that is responsive to torque provided by the motor 18 and available at the output shaft 38, fixed a speed control for the motor 18, and a timing circuit, and is operative to disable the motor 18 after a fixed time or predetermined torque has been sensed. These provisions ensure that a bottle cap is not overly tightened onto the threaded neck of a bottle, and, that the motor is disabled if the operator continues to hold the bottle pressed upwardly in the chuck, either in the bottle capping or uncapping mode.

As will be appreciated, the device of the present application is capable of modification in many respects to accomplish operations other than the capping or uncapping of bottles, and finds application in any situation in which a threaded member is to be either tightened down or removed only. Further, it will be appreciated that while the device of the invention has been described as itself being held stationary, the device itself could be portable, and employed for removing and replacing caps of bottles fixed against rotation about their longitudinal axis. For example, the device could be manipulated from a position exterior to a fume cabinet to effect operations within the fume cabinet.

All such variations are encompassed that fall within the scope of the appended claims.

I claim:

1. A machine for the removal and reapplication of threaded caps from bottles having a screw threaded neck, comprising:

a frame;

a reversible electric motor supported by said frame;

an output shaft of said motor;

a chuck supported on said output shaft for rotation in unison with said output shaft and moveable between a first and a second position longitudinally of said output shaft;

electronic controller means controlling said motor and supported on said frame;

micro switch means for signaling the electronic controller; and, an actuator of said switch means extending into the path of axial movement of said chuck for actuating said switch means upon movement of said chuck from a first position to a second position;

whereby, an initial axial movement of said chuck in one direction will actuate said electronic controller to cause rotation of said electric motor in one direction, and, a subsequent axial movement of said chuck in said one direction will cause further actuation of said micro switch means to produce reversal of the direction of rotation of said reversible electric motor.

2. The machine of claim 1, further including a pin extending radially of said output shaft and which extends into a closed ended slot in a supporting collar of said chuck.

3. The machine of claim 2, in which said chuck includes a circular base plate fixed on said collar and having slots extending therethrough, an adjustment plate journalled on said collar for rotational movement relative thereto, said adjustment plate also having slots extending therethrough, the slots of one of said base plate and adjustment plate extending radially of the axis of said collar and the slots of the other of said base plate and adjustment plate extending arcuately of said other plate and converging towards the axis of said collar, post means extending through respective pairs of said radial and arcuate slots, means inhibiting rotation of said post means about the longitudinal axis of said respective post means, and locking means extending between said base plate and adjustment plate for locking said plates to each other in a selected position of angular adjustment.

4. The machine of claim 3, including resiliently compressible buffer means carried by said posts for gripping engagement with a bottle cap.

5. The machine of claim 3, in which said posts are at all times equidistantly spaced one from the other about the axis of said collar and radially of said collar, thus providing dynamic balancing for said chuck.

6. The machine according to claim 1, including reduction gear means interposed between an output of said electric motor and said output shaft and driven by said electric motor.

7. The machine of claim 1, including electronic circuit means including said micro switch means, and which also includes a manually operable direction selector switch for setting the mode of rotation of said electric motor.

8. The machine of claim 7, including time, motor direction, motor speed, and motor torque limiting means incorporated into said electronic circuit means.

* * * * *